United States Patent [19]

Bonalumi

[11] 3,992,755

[45] Nov. 23, 1976

[54] APPARATUS FOR STRIPPING FIBROUS WEB FROM A ROTATING CYLINDER IN A TEXTILE MACHINE

[76] Inventor: Ettore Bonalumi, Via Lega Lombarda 5, Bergamo, Italy 24100

[22] Filed: Nov. 13, 1974

[21] Appl. No.: 523,321

[30] Foreign Application Priority Data

Dec. 11, 1973 Italy ..... 2969/73

[52] U.S. Cl. ..... 19/106 R

[51] Int. Cl.[2] ..... D01G 15/46

[58] Field of Search ..... 19/106 R, 150, 157, 19/159, 112, 114, 105, 65 CR

[56] References Cited

UNITED STATES PATENTS

| | | | |
|---|---|---|---|
| 3,136,005 | 6/1964 | Reiterer | 19/114 |

FOREIGN PATENTS OR APPLICATIONS

| | | | |
|---|---|---|---|
| 539,244 | 7/1955 | Belgium | 19/65 CR |
| 435,055 | 10/1967 | Switzerland | 19/106 R |
| 1,017,802 | 1/1966 | United Kingdom | 19/106 R |

*Primary Examiner*—Dorsey Newton

[57] ABSTRACT

In apparatus for stripping a fibrous web from the doffer of a carding machine, provision is made for pneumatically assisting the dragging rollers to remove web from the stripping roller. This is achieved by directing air impulses towards a dragging roller from within the stripping roller. An air chamber within the stripping roller is arranged such that the impulses are directed in a predetermined direction, as apertures in the stripping roller register therewith. Carding cloth covering the stripping roller has appropriately, toothed, stepped windings.

2 Claims, 10 Drawing Figures

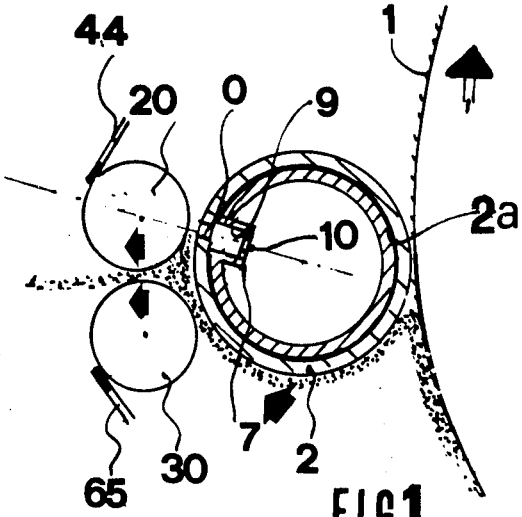
FIG.1
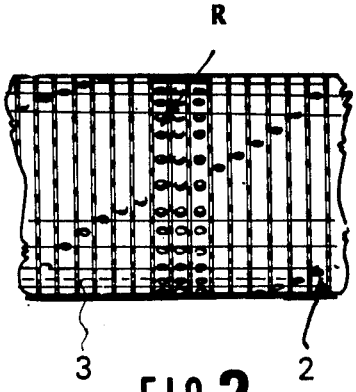
FIG.2
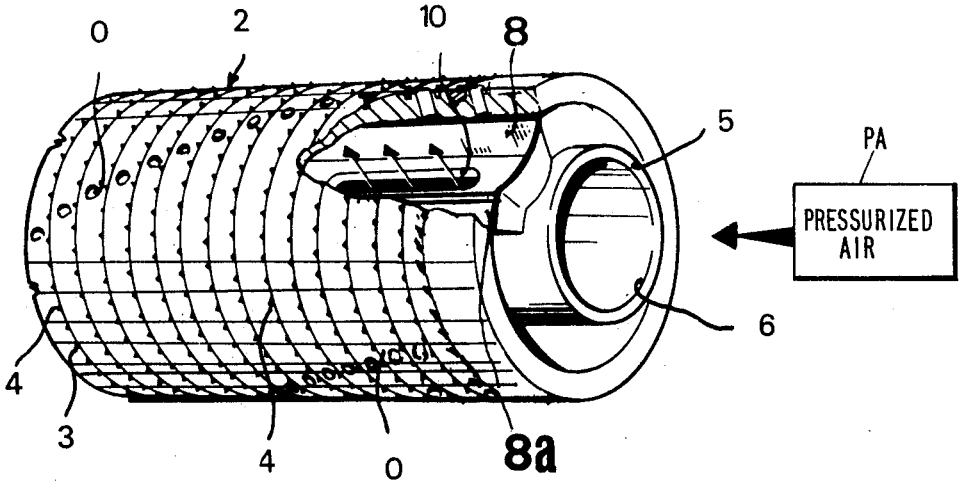
FIG.3
FIG.4
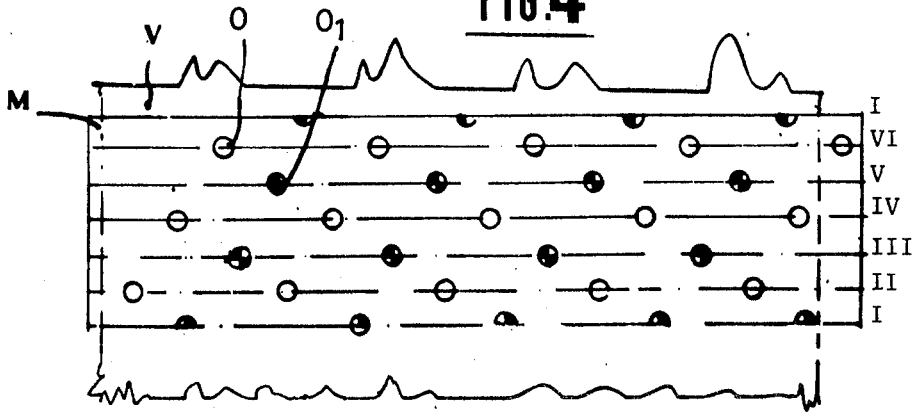

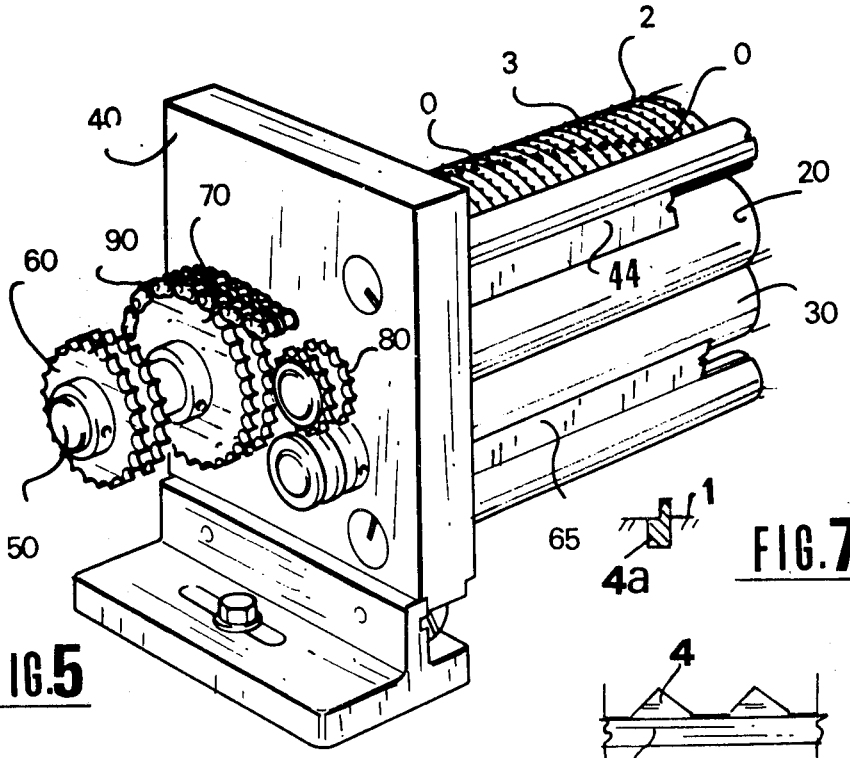
FIG.5
FIG.7
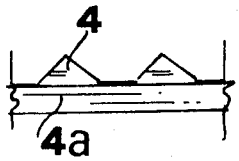
FIG.7a
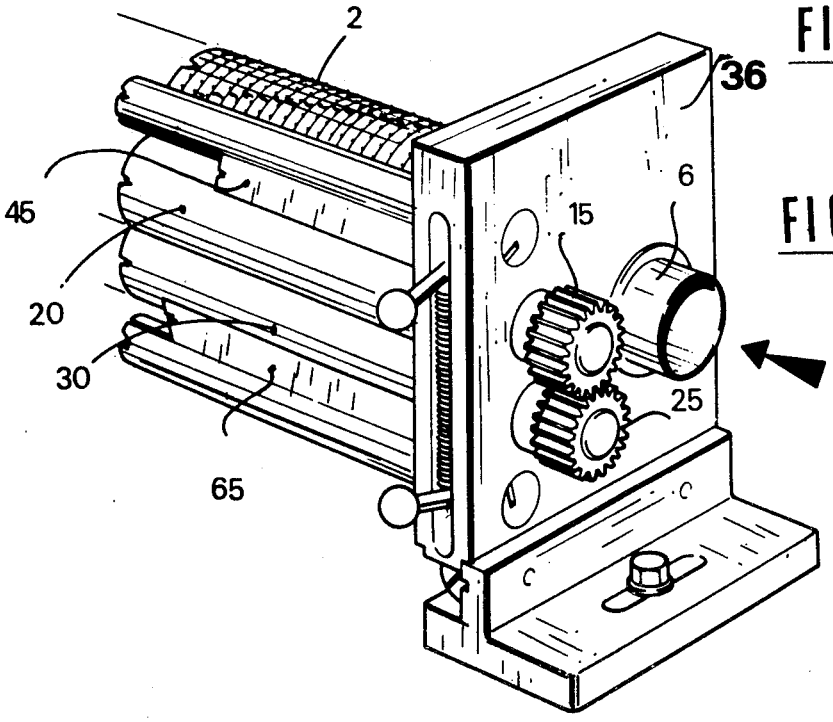
FIG.6

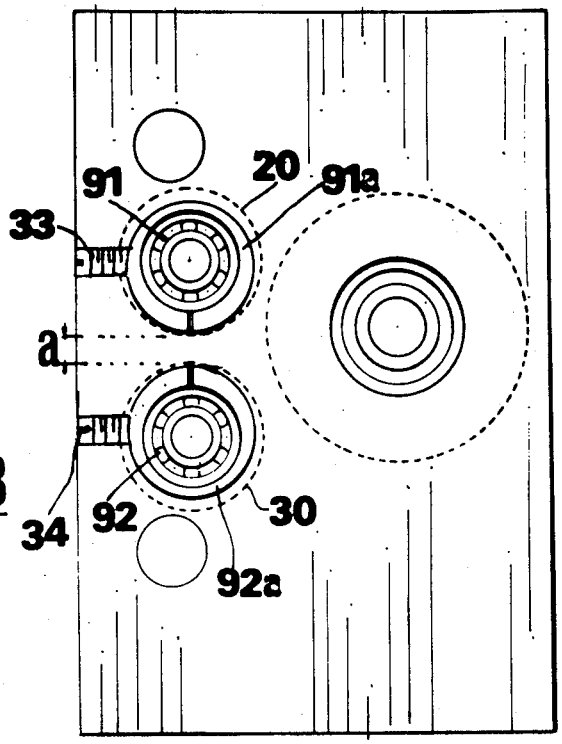
FIG.8
FIG.9
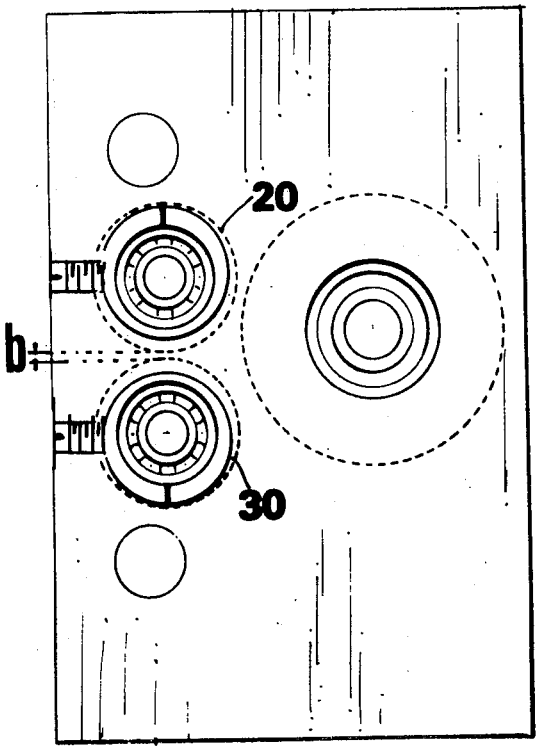

APPARATUS FOR STRIPPING FIBROUS WEB FROM A ROTATING CYLINDER IN A TEXTILE MACHINE

BACKGROUND OF THE INVENTION

This invention is concerned with an improved method and apparatus for stripping a fibrous web from a rotating cylinder in a textile machine, particularly but not exclusively from a doffer in a carding machine.

It is an object of the invention to eliminate the drawback inherent in the use of vibrating stripping combs which are sometimes employed to strip a fibrous web from a rotative cylinder in a textile machine. Such combs for mechanical reasons have a speed limit of 3000 picks per minute and therefore cannot strip the doffer of carding machines of modern design the output of which is more than 90 meters per minute and in some instances exceeds 140 – 150 meters per minute. The use of stripping rollers provided with card clothing is known, but such rollers are not of universal application and require a deionization device for the air which becomes electrostatically charged, particularly when synthetic fibers are to be processed.

SUMMARY OF THE INVENTION

According to the present invention there is provided a method for stripping a web issuing from a carding machine comprising the steps of facilitating the stripping of the web from a rotating stripping roller by employing pressurized air impulses issuing through apertures in the stripping roller covering, the apertures being distributed over the major surface of the covering, arranging for the air impulses to be periodic and to issue as the apertures register on rotation of the stripping roller with an air chamber within the said roller, and arranging the location of which so that such registration occurs relative to a plane through the axes of rotation of the upper dragging roller and the stripping roller.

According to the present invention there is also provided an apparatus for stripping a web issuing from a carding machine comprising a hollow stripping roller arranged for rotation and having a plurality of apertures over its carding surface, stationary means within the stripping roller defining with the adjacent surface of the stripping roller an air chamber, a pressurized air source to feed the said air chamber, the said apertures during rotation of the stripping roller registering successively with the said air chamber and creating air impulses to facilitate stripping of the web, the air chamber being arranged to direct the impulses relative to a predetermined plane with regard to web dragging rollers.

Embodiments of the invention will now be described, by way of example only, with reference to the accompanying drawings;

BRIEF DESCRIPTION OF THE DRAWINGS

FIG. 1 is a somewhat schematic vertical sectional elevational view perpendicular to the axes of a doffer and associated stripping roller and to the axes of two rollers dragging the web to the calenders or to a web drawing apparatus such as that known sold under the T. M. CARDPEN.

FIG. 2 is a front elevational view of the central portion only of a stripping roller such as shown in FIG. 1 but modified for large front carding machines;

FIG. 3 is a partial perspective view of a modified stripping roller;

FIG. 4 is a developed plan view of the stripping roller of FIG. 3 or a modification thereof;

FIGS. 5 and 6 are fragmentary perspective views showing respectively the two opposite sides of a stripping roller support structure;

FIGS. 7 and 7a show a carding cloth covering portion for the stripping roller respectively in sectional and side view.

FIGS. 8 and 9 show two elevational side views of FIG. 6 illustrating the operation of a device for adjusting the gap between the two web dragging rollers.

DETAILED DESCRIPTION OF EMBODIMENTS

In the example illustrated in FIG. 1 a doffer 1 is provided in known manner with a carding cloth consisting of a metal toothed band wound around the cylindrical surface of the doffer 1. The windings of the carding cloth are very close so as to give a serrated surface without significant discontinuities.

A stripping roller 2 according to this invention is provided with a card clothing (FIG. 7, 7*a*) consisting of an extruded metallic band 4 punched with isosceles triangle profiled teeth. The step of the windings is 12–15 times the thickness of the band and therefore relatively large (see FIGS. 2, 3). The foot 4*a* of the band 4 is housed in a groove milled in the outer surface of the stripping roller and the band is mounted under tension. As may be seen from FIG. 7*a* the punched band is housed so that only the teeth extend above the surface of the stripping roller.

The stripping roller 2 is hollow and houses a stationary hollow cylinder 5 adapted to be fed with pressurized air through an inlet union which is preferably coaxially disposed as in the example shown in FIG. 3. The stationary hollow cylinder 5 is preferably made of aluminum and extruded with a longitudinal depression or groove 7 in its surface so as to define with the internal surface 2*a* of the stripping roller 2 an air chamber 9 to be fed as stated, by the pressurized air through one or more apertures 10 bored in the bottom wall of the said groove 7 and communicating with the air inlet. The wall of the stripping roller 2 is formed with a number of apertures or holes 0, 0$^1$ — see FIG. 4 — arranged to be periodically fed with pressurized air only when the holes open to the pressurized air chamber 9 during the rotation of the stripping roller. A pair of web dragging rollers 20 and 30 are provided adjacent to the pressurized air chamber 9 and are arranged such that the plane containing the axis of the hollow stationary cylinder 5 and the axis of the web dragging roller 20 coincides with the medial longitudinal plane of pressurized air chamber 9 (see FIG. 1).

The stationary hollow cylinder 5, the stripping roller 2 and the two web dragging rollers 20 and 30 are mounted to rotate in two supporting members 36 and 40 secured to the carding machine frame. The two rollers 20 and 30 are driven oppositively, as shown, by a drive spindle 50 (FIG. 5). The latter carries a toothed pinion 60 and is fixed to the stripping roller 2 as well to a toothed wheel 70. The spindle of the upper roller 20 terminates with a toothed pinion 80. A link chain 90 engages the toothed wheels 70 and 80 whereby the upper roller 20 and the stripping roller 2 are rotated in the same direction (see FIG. 1). A pinion 15 is fixed to the other end of the upper roller 20 and meshes with a pinion 25 on the lower roller 30 so that the lower roller 30 is rotated oppositely to the upper roller 20.

Whereas the stationary hollow cylinder 5 illustrated in FIG. 1 is dimensioned to conform closely to the inner surface of the stripping roller 2, as shown by the FIG. 3 the internal stationary hollow cylinder 5 instead of having a groove profiled depression 7 may be provided with two projecting ribs 8 and 8a projecting from its surface. The apertures for the passage of the air may be milled from the portion of the cylinder located between the two said ribs whereby a greater clearance is provided between the stripping roller 2 and the surface of the internal stationary cylinders 5.

In order to adapt the stripping apparatus to the nature e.g. thickness or weight of any web, the device as shown in the FIGS. 8 and 9 permits adjustment of the gap (*a-b*) between the two dragging feeding rollers 20 and 30, whereby a correct gripping of the web may be secured. Thus in this preferred embodiment the spindles of rollers 20, 30 are mounted in bearings 91, 92, the outside bush 91*a*, 92*a* of each which is eccentric with respect to the axis of the web dragging rollers 20, 30 with both of said outside bushes being provided with a locking device consisting of a dowel 33, 34 respectively as shown.

Clearly if a 180° rotation of bushes is effected it is possible to pass from a minimum of gap (clearance) (*b*) (FIG. 9) for example of 0.2 millimeters (for a web of 3–10 grs/m² of cotton carding machines) to a maximum of clearance (a) of 2 millimeters (FIG. 8) for a web of 70 grs/m² of a wool carding machine.

Two cleaning blades 44–65 are arranged smoothly pressed respectively against the web dragging rollers 20–30.

The two web dragging rollers may be driven at a speed securing a slight web drawing.

The stationary roller 5 may be mounted so as to permit an angular adjustment thereof in order to find the optimum position of incidence for the pressurized air currents against the surface of the upper web dragging roller 20.

DESCRIPTION OF OPERATION

On each registration of the apertures 0 (0¹) on rotation of the stripping roller 2 with the pressurized air chamber 9, a number of pressurized air impulses are created. These impulses assist the stripping roller 2 to progressively detach the web (V) from the doffer. When no aperture registers with the pressurized air chamber 9 a pressure gradient develops in the air chamber 9.

With reference to the FIG. 4, (M) shows the developed surface of the stripping roller 2 and (V) the web. The web V continuously receives a series of impulses directed to zones distributed along successives generatrices I, . . . VI. Consequently the impulse locations are distributed over the whole web surface which ensures that an easy and full detachment of web V from the stripping roller 2 is effected. If the arrangement of the apertures is staggered as shown by the crossed circles 0¹, the impulse frequence is doubled. Such detachment may be likened to the turning over of a book page.

The pressurized air currents, namely the air impulses through the apertures of the stripping roller 2 and the continuous small air currents leaking through the apertures not registering with the pressurized air chamber 9, create a deionisation environment which suppresses static electricity.

By providing the stripping roller with the card clothing having isosceles triangle profiled teeth, the card clothing may be applied to the stripping device which is to be rotated either clockwise or anti-clockwise. Such a stripping roller may therefore be incorporated in many different carding machines.

In FIG. 2 the stripping roller is provided with a zone R with closer holes for the purpose of longitudinally pneumatically dividing the web V into two sections as is often required in larger sized carding machines. This may eliminate the use of known web cutting devices. Such a zone R is advantageous for wool carding machines presenting a large front, double calendering devices and two individual cans.

A fan may be arranged within the hollow cylinder 5. The fan may be coupled electrically with an electric motor which may be mounted on a shoulder of the machine. Alternatively, the fan may be driven by the transmission gearing of the carding machine through a gear train.

The device described may incorporate modifications known in the art. In addition no specific limitation is imposed for the number and the disposition of the holes on the stripping roller. One of the web dragging rollers, by example web dragging roller 20, may have a helical groove which facilitates conveying the web from the web dragging rollers to the calendering apparatus (not shown).

From the FIGS. 2 and 3 is should be apparent that spiral winding of card clothing may be effected with one, two or three separate windings. The spiral step for two adjacent windings is 12–15 times the thickness of the card clothing steel band.

When stripping a web consisting of synthetic fibres with high electrostatic charge, it is appropriate to humidify the air passing into the opening 6 of the stationary cylinder 5.

When stripping a web consisting of cotton fiber, the air currents may only be necessary whilst initiating the stripping and thereafter the air impulses may be discontinued.

What I claim is:

1. An apparatus for stripping a web issuing from a carding machine comprising in combination: a doffer an upper and a lower web dragging roller, arranged for rotation in opposite direction, a hollow stripping roller having a spirally wound metallic carding clothing and arranged for rotation as the said upper web dragging roller and having a plurality of peripherally spaced spiral rows of apertures thereover, the said hollow stripping roller defining with the doffer a generatrix wherein the web is picked up from the doffer by means of the said card clothing, the latter being able to pick up the web from the said generatrix and to transfer the same to a diametrally opposed generatrix of the said hollow stripping roller, stationary means within the stripping roller defining with the adjacent surface of the stripping roller an air elongated chamber, a pressurized air source to feed the said air elongated chamber, the said apertures during rotation of the stripping roller registering successively with the said elongated air chamber and creating air impulses to facilitate stripping of the web from the stripping roller, the air chamber being arranged to direct the impulses in a predetermined plane against the said upper dragging roller, the said plane containing the axis of the said upper web dragging roller, the said elongated air chamber and the axis of the stripping roller, the card clothing being made of metallic band profiled with spaced isosceles triangles profiled teeth wound around the stripping roller, with the spiral step for two adjacent windings being 12–15 times the thickness of the metallic card clothing band.

2. Apparatus according to the claim 1, wherein an intermediate portion of the stripping roller has a higher density of apertures arranged in an annular zone, this zone providing a means to pneumatically divide an issuing web into two separate portions.

* * * * *